US007604400B2

(12) United States Patent
Thompson et al.

(10) Patent No.: US 7,604,400 B2
(45) Date of Patent: Oct. 20, 2009

(54) SYSTEM AND METHOD FOR PROVIDING DIAGNOSTIC INFORMATION IN A PROCESSING PATH OF A COAL GASIFICATION SYSTEM

(75) Inventors: Anthony Mark Thompson, Niskayuna, NY (US); James Scott Vartuli, Rexford, NY (US); Kenneth Brakeley Welles, Scotia, NY (US); Emad Andarawis Andarawis, Ballston Lake, NY (US); Wayne Charles Hasz, Pownal, VT (US); John Erik Hershey, Ballston Lake, NY (US); Ertugrul Berkcan, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/833,227

(22) Filed: Aug. 2, 2007

(65) Prior Publication Data

US 2009/0031787 A1 Feb. 5, 2009

(51) Int. Cl.
*G01K 11/00* (2006.01)

(52) U.S. Cl. ..... 374/160

(58) Field of Classification Search ..... None
See application file for complete search history.

(56) References Cited

U.S. PATENT DOCUMENTS

| | | | | |
|---|---|---|---|---|
| 2,798,893 | A * | 7/1957 | Winkler | 136/231 |
| 4,396,401 | A * | 8/1983 | Davis | 48/85.2 |
| 4,438,649 | A * | 3/1984 | Gilman | 374/179 |
| 4,829,812 | A * | 5/1989 | Parks et al. | 73/12.04 |
| 5,281,243 | A | 1/1994 | Leininger | |
| 5,490,475 | A * | 2/1996 | Bryant et al. | 116/217 |
| 6,051,195 | A | 4/2000 | Deeke et al. | |
| 6,053,632 | A | 4/2000 | Leininger | |
| 2006/0263496 | A1 * | 11/2006 | Cross et al. | 426/293 |
| 2007/0137107 | A1 * | 6/2007 | Barnicki | 48/198.3 |

* cited by examiner

*Primary Examiner*—Robert R Raevis
(74) *Attorney, Agent, or Firm*—Ann M. Agosti

(57) ABSTRACT

A system and method for gathering diagnostic information relating to an operating condition of a gas stream or processing path of a coal gasification system is disclosed. The information is gathered by deploying one or more specially constructed modules or seeds that proceed through the gas stream of the coal gasification system as part of the mass flow of the gas stream. The seed may be physically recoverable in which an outer material of the seed ablates when exposed to a predetermined temperature of the gas stream. The seed may be physically non-recoverable in which electronic circuitry transmits a signal to a receiver relating to the temperature of the gas stream.

2 Claims, 3 Drawing Sheets

SYSTEM AND METHOD FOR PROVIDING DIAGNOSTIC INFORMATION IN A PROCESSING PATH OF A COAL GASIFICATION SYSTEM

BACKGROUND OF THE INVENTION

This invention relates generally to monitoring and diagnosing conditions within a processing system. More specifically, the invention is directed to a system and method for gathering diagnostic information based on specially constructed modules or seeds that travel through a flow path of the coal gasification system.

Broadly, gasification is the creation of combustible gas known as synthesis gas and commonly referred to as "syngas" herein, from carbon-containing fuels. Gasification is a well-known industrial process used for converting solid, liquid and gaseous feedstocks using reactants such as air, oxygen, and steam into gases such as hydrogen, carbon monoxide, carbon dioxide, and methane. The resulting gases can be used for generating electrical power, producing heat and steam, or as a feedstock for the production of various chemicals and liquid fuels, or any combination of the above.

In the gasification of a hydrocarbon fuel such as coal or coke, for example, the fuel, in particulated form, is fed into the gasifier reaction chamber together with an oxidizing gas. Reaction of the particulated fuel with the oxidizing gas results in the production of a raw synthesis gas which is carried from the gasifier for further treatment. The events within the reaction chamber produce not only a usable gas, but also a slag having a constituency which depends to a large degree on the fuel being burned and the operating. Because the gasifier for this purpose must be operated at a relatively high temperature and pressure which is well known in the industry, conditions within the combustion chamber must be monitored at all times. Of particular importance, during the initial start-up period when the fuel and oxidant mixture is injected into the reaction chamber, it is essential that the reaction ignition event takes place immediately. Any substantial delay could permit the accumulation of unsafe quantities of fuel and gas to the point where there is the danger of having an uncontrolled explosion within the reaction chamber as well as within other process equipment downstream of the gasifier. It is desirable, therefore, as a safety measure, to monitor the temperature within the gasifier not only during periods of normal operation, but also during the initial startup stage.

Normally, gasifiers are equipped with one or more temperature monitoring devices. One such device is the thermocouple, a plurality of which may be disposed throughout the refractory lined walls of the gasifier reaction chamber. The thermocouples are placed in the gasifier in such a way that they are separated by a thin layer of refractory from the flames in the reaction chamber. This is done to protect the relatively fragile thermocouple junctions from the very aggressive environment inside the reaction chamber. Consequently, the thermocouples do not sense the reaction temperature directly, but instead respond to the heat transmitted through the thin refractory layer from the reaction chamber. It can be appreciated that, as a result of the lag-time inherent in conductive heat transfer, there can be a considerable delay in thermocouple response to critical changes. This is especially true during gasifier startup when reaction initiation results in a rapid temperature rise which must be detected in order to confirm that the reactions have initiated and that unsafe levels of unreacted material are not accumulating within the gasifier and other downstream equipment. In addition, heat transfer lag-times effect thermocouple response to operating condition changes during normal gasifier operation. Thermocouples have also been used as single-point measurement devices within the radiant syngas cooler (RSC).

As an alternative to thermocouples, pyrometers are sometimes used to measure reaction temperature. Physically, the pyrometer is mounted external to the reactor and views the reaction chamber through a gas purged sight tube which normally extends from the pyrometer to the reaction chamber.

A major weakness of the pyrometer temperature monitor arises from the difficulty encountered in keeping the sight tube free of obstructions. The potential for obstruction is great, resulting from the atmosphere within the reaction chamber which is characterized by rapid swirling of particulate carrying gas. Further, a slag which results from ungasifiable material within the fuel, will likewise swirl around the reaction chamber, contacting the walls of the latter. In the course of gravitating towards the lower end of the gasifier, slag normally displays a tendency to cling to the reaction chamber walls. The clinging slag and the swirling particles interfere with the operation of the pyrometer sight tubes which are positioned in the reaction chamber walls. In addition, during the gasifier startup sequence, fuel is introduced into the reactor before oxidant. Depending upon the circumstances and upon the fuel, coal-water slurry for example, there exists an increased tendency for obstruction of the pyrometer sight tubes with unreacted fuel.

These obstructions prevent verification of startup by the pyrometer's response to reactor temperature change. While the problem of obstruction of the pyrometer sight path can in many instances be dealt with by proper adjustment of the sight tube purge gas, there are some difficulties inherent in the use of purge gas itself. If recycled process gas is used, the gas must first be cleaned so that it is entirely free of moisture and particulates, and then compressed for re-injection through the sight tube into the reaction chamber. This may require additional equipment (e.g. oil-free compressor, gas cleaning equipment, etc.) which adds to operations and maintenance expense.

Alternately, if a non-process gas (e.g. an inert gas such as nitrogen) is used as the purge gas, the product from the reaction chamber will be slightly diluted by the pyrometer purge gas. If the gasifier is producing a synthesis gas for a chemical process, the presence of a diluent gas may not be acceptable.

Much simulation has been performed in order to optimize these components, such as the feed injector, the gasifier and the radiant syngas cooler (RSC), and the behavior and thermal profile of the flame proceeding from the injector. However, there has been limited experimental validation of these simulations primary due to the inability of conventional sensors and probes to function or even survive the system's internal atmosphere. In view of the foregoing, the invention overcomes the problems encountered with both thermocouples and optical pyrometers to monitor the actual variables of interest within the gasification flow path.

BRIEF DESCRIPTION OF THE INVENTION

One embodiment of the invention is directed to a coal gasification system that comprises a gasifier; a radiant syngas cooler (RSC) for receiving gasification products from the gasifier; and a seed introduced into a gas stream of the coal gasification system, wherein the seed gathers diagnostic information relating to an operating condition of the gas stream while traveling through the coal gasification system.

Another embodiment of the invention is directed to a seed for gathering diagnostic information relating to an operating condition while traveling through a gas stream of a coal gasification system, the seed comprising a core and at least one concentric shell surrounding the core.

Another embodiment of the invention is directed to a seed for gathering diagnostic information relating to an operating condition while traveling through a gas stream of a coal gasification system, the seed comprising a first resonant circuit for emitting a resonant frequency depending on a temperature of the first resonant circuit.

A method of gathering diagnostic information in a coal gasification system comprises the step of introducing a seed into a gas stream of the coal gasification system, whereby the seed gathers diagnostic information relating to an operating condition while traveling through the gas stream of the coal gasification system.

DETAILED DESCRIPTION OF THE INVENTION

Figure 1:
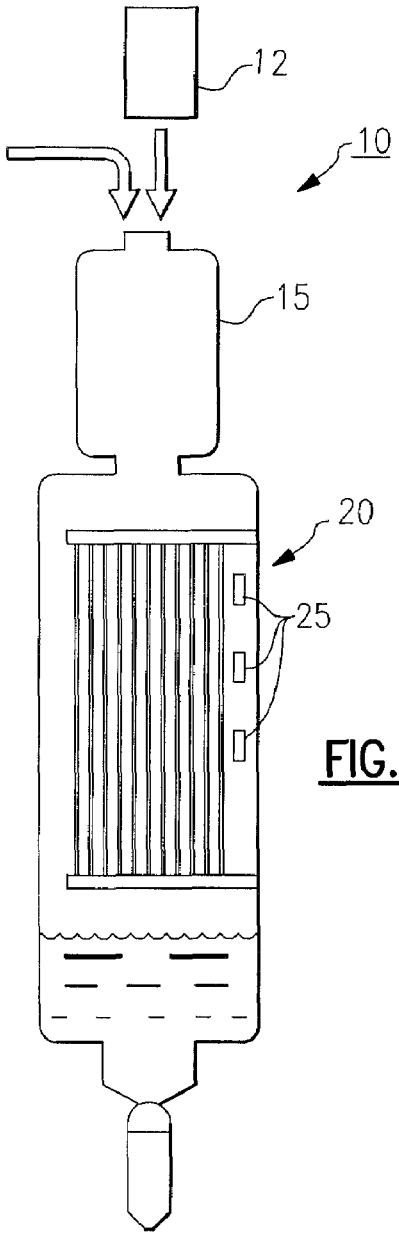
FIG. 1 is a schematic illustration of some major components of a coal gasification system according to an embodiment of the invention.

FIG. 1 is a schematic illustration of some major components of a coal gasification system, generally designated at 10. Oxygen and a water-coal slurry are introduced into a gasifier 15 through a feed injector 12 and gasification proceeds. The gasification products in the form of a gas stream or processing path are introduced into the top of a radiant syngas cooler (RSC) 20. Thus, the gas stream begins in the gasifier 15 and travels through the RSC 20. A plurality of soot blower ports 25 is positioned at various heights around the RSC 20. Conditions of the gas stream within the gasifier 15 are typically a local maximum reaction temperature of about 4000° F. with a gasifier exit temperature of greater than about 2500° F. and internal pressure greater than about 500 psi. Conditions within the RSC 20 are typically a temperature profile ranging from about 300° F. to about 2600° F. at a pressure of also greater than about 500 psi.

As used herein, a "seed" is defined as a specially constructed module that is introduced into the gas stream or processing path of the coal gasification system in order to help diagnose operating conditions within the coal gasification system. By way of example and not limitation, these operating conditions include average mass flow rates as a function of location within the system, temperature profiles, flame thermometry, and chemical analysis of the mass flow. The external geometry of a seed may be varied. Spheres or prolate spheroids might accommodate most aerodynamic requirements but a seed may be designed to exhibit scenario-desirable aerodynamic interactions that are, for purpose of example and not limitation, enabled by equipping the main body of a seed with a specially designed aerodynamic appendage, such as a propeller and the like. One embodiment of such a propeller is shaped similar to the maple tree seed propeller. The equipage of such an aerodynamic appendage moderates the speed with which the seed may move within the gas path. Such an appendage may be fabricated out of a shape memory alloy and deploy when the seed temperature reaches the critical point for the shape memory alloy structure to resume its preset shape. A further embodiment of the seed 200 is the addition of a coating of graphite on the seed's surface. The graphite coating serves to prolong the useful life of the seed within the hot gas path environment.

A seed gathers diagnostic information as it traverses the processing path and it transfers this information in one of two modalities. The first modality is on physical recovery of the seed after it has passed through the system or a portion thereof. The second modality is non-physical recovery of the seed and the information transfer takes place while the seed is in transit within the gasification system or has completed its transit of the system or during both of these opportunities. The seed's mechanism for gathering diagnostic information may be chemical-based, electronic-based, or a combination thereof.

Figure 2:
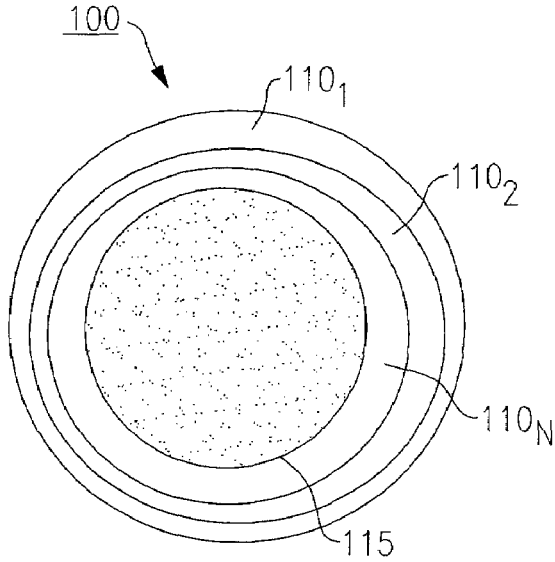
FIG. 2 is a cross-sectional view of a physically recoverable seed for measuring temperature according to a first embodiment.

One embodiment of a physically recovered seed that is useful for studying temperature profiles is the seed 100 illustrated in FIG. 2. The seed 100 consists of a spherical core mass 115 and N nominally concentric shells, $\mathbf{110}_1$, $\mathbf{110}_2$, . . . , $\mathbf{110}_N$, proceeding from outermost to innermost shell. The shells $\mathbf{110}_1$, $\mathbf{110}_2$, . . . , $\mathbf{110}_N$ are crafted such that they are ablated by exposure to a certain temperature X exposure-time product. The core mass 115 is selected to govern the seed's propagation time through the system. By physically recovering the seed 100 and determining the level of ablation by the exposed shell and also determining the core mass 115, it will be possible to estimate moments of the temperature distribution within the processing path. It should be noted that insertion of the seeds might be at the top of the RSC 20, for example, or through any of the soot blower ports 25 of FIG. 1.

Another embodiment of a physically recovered seed that is useful for studying composition profiles is also described by the seed 100 illustrated in FIG. 2. The seed 100 consists of a spherical core mass 115 and N nominally concentric shells, $\mathbf{110}_1$, $\mathbf{110}_2$, . . . , $\mathbf{110}_N$, proceeding from outermost to innermost shell. The shells $\mathbf{110}_1$, $\mathbf{110}_2$, . . . , $\mathbf{110}_N$ are crafted such that they react with the gaseous atmosphere. For example, the shell could be fabricated with additions of NiO or Ni. Reaction with S within the gaseous phase would produce NiS. The core mass 115 is selected to govern the seed's propagation time through the system. By physically recovering the seed 100 and determining the level of reaction it would be possible to estimate the integrated activity of species as a function of the processing path. It should be noted that insertion of the seeds might be at the top of the RSC, for example, or through any of the soot blower ports 25 of FIG. 1.

Figure 3:
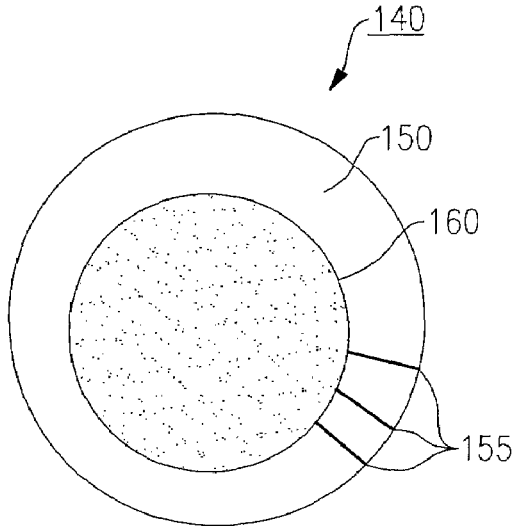
FIG. 3 is a cross-sectional view of a physically recoverable seed for measuring reactivity according to a second embodiment.

Another embodiment of a physically recovered seed that is useful for studying temperature profiles is the seed 140 illustrated in FIG. 3. The seed 140 consists of a spherical core 160 that houses data recordation components (not illustrated). The core 160 is surrounded by a concentric insulation shell 150 that provides protection to the core-housed data recordation components against the traversed hot and corrosive atmosphere of the processing path. One or more foramens 155 constitute penetration of the insulation shell 150 for data pathways for one or more sensors positioned proximate to the outer shell of the insulation shell 150 or to function as observation apertures for sensors located proximate to the inner surface of the insulation shell 150. As in the previous embodiment, it should be noted that insertion of the seeds might be at the top of the RSC, for example, or through any of the soot blower ports 25 of FIG. 1.

To aid in the recovery of a seed, another embodiment includes a layer that fluoresces, is magnetic or a combination of both. This could be achieved by suitable section of materials. The seeds could be removed manually under suitable light conditions, or automatically under the influence of a magnetic field.

It will be appreciated that the physically recoverable seed of the invention is not limited to a seed having a spherical shape, and that the invention can be practiced with a seed having any desirable shape. For example, the core may be irregular in shape with an outer layer having varying thickness. In addition, the seed may have a graded index material having a density or other material property that changes with thickness.

An embodiment of a non-physically recoverable seed that is useful for studying the internal gas flows and temperature profiles within the gasification system is to construct the seed 100 or the seed 140 in such a manner as to modify its terminal velocity within the gas path. This can be done by adjusting the sphere's radius, R, and weight W. In the case of a free-falling object with no drag, the terminal velocity is unbounded and the time, $t_L$, that the object will take to fall a distance s, starting from rest, is $t_L=\sqrt{2s/g}$ where g is the acceleration due to gravity. If there is drag, then the time for the object to fall a distance s, starting from rest, is upper bounded by $t_U=s/v_t$, where $v_t$ is the terminal velocity. The terminal velocity of a sphere, discounting wall effects, is $v_t=\sqrt{(2W)/(C_d\rho A)}$, where $C_d$ is the drag coefficient, ρ is the gas density, and A is the frontal area of the sphere, ie, $A=\pi R^2$. The drag coefficient of a sphere lies in the range 0.07 to 0.50, depending upon the Reynolds number respecting laminar or turbulent flow conditions. Thus, the time the seed spends falling within the gas path can be altered by constructing the seed with a different weight or radius.

Figure 4:
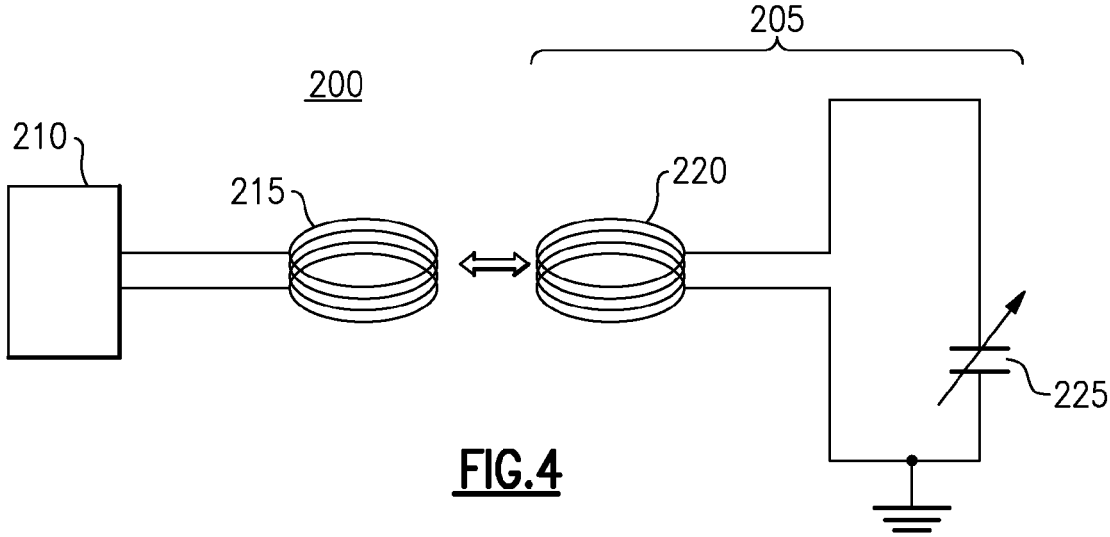
FIG. 4 is a schematic illustration of an electronic circuit for a physically non-recoverable seed according to a first embodiment.

An embodiment of a non-physically recoverable seed that is useful for studying temperature within the gasification system processing path is illustrated in FIG. 4. The seed 200 houses a resonant circuit 205 composed of a coil 220 and a capacitor 225 that has a dielectric that is strongly dependent on temperature such as the perovskite mineral family member $BaTiO_3$. In one embodiment, the resonant circuit 205 is housed in the core of the seed 200. The coil 220 also serves as an antenna for receiving an excitation signal from a remote reader comprising driver electronics 210 and an antenna 215. When the interrogation signal has a significant spectral component at the resonance of the resonant circuit housed by the seed, the resonant circuit housed by the seed will radiate a strong spectral component via coil 220 at the resonant frequency. This radiation is received and analyzed by a receiver, not shown. The resonant frequency may be determined in many ways. One way, by means of example and not of limitation, is to excite the interrogation antenna 215 with a swept sine wave and look for a the maximum response from the resonant circuit housed by the seed.

Figure 5:
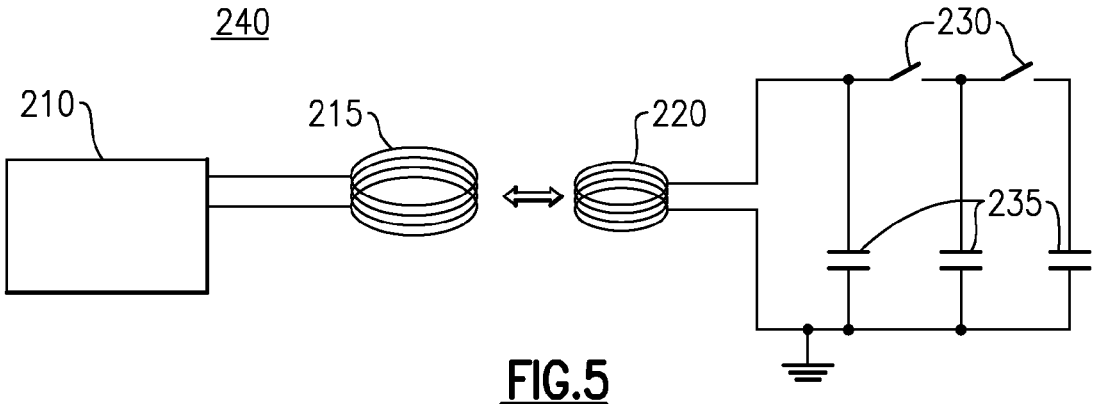
FIG. 5 is a schematic illustration of an electronic circuit for a physically non-recoverable seed according to a second embodiment.

A variation on the embodiment illustrated in FIG. 4 is provided by the embodiment illustrated in FIG. 5. The embodiment is similar to the embodiment illustrated in FIG. 4 with the substitution of the capacitor 225 by a network of switches 230 and nominally heat-invariant dielectric capacitors 235 in the core of the seed 240. The switches 230 may be fusible links that transition either from a conductive state to a non-conductive state or from a non-conductive state to a conductive state at a specific temperature, the specific temperature being unique for each fusible link. The circuit composed of fusible links 230 and capacitors 235 is thus capable of producing a set of discrete resonances with the specific resonance exhibited chosen by the temperature experienced by the circuit. The strong spectral component of the exhibited resonance will be radiated via coil 220. As was the case for the previous embodiment, this radiation will be received and analyzed by a receiver, not shown. Also as for the previous embodiment, the resonant frequency may be determined in many ways. As in the previous embodiment, one of the ways, for purpose of example and not limitation, is to excite the interrogation antenna 215 with a swept sine wave and look for a the maximum response from the resonant circuit housed by the seed.

Figure 6:
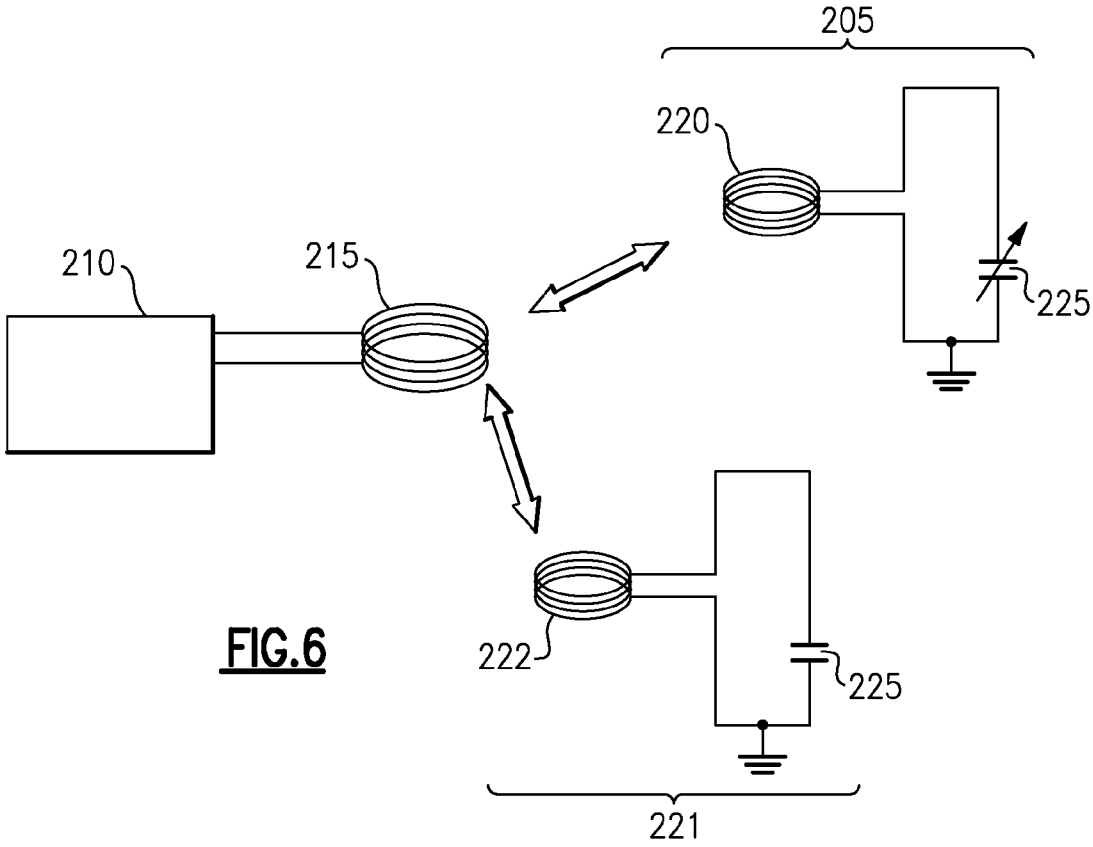
FIG. 6 is a schematic illustration of an electronic circuit for a physically non-recoverable seed according to a third embodiment.

A further variation on the embodiment illustrated in FIG. 4 is provided by the embodiment illustrated in FIG. 6. The embodiment is similar to the embodiment illustrated in FIG. 4 with the a second resonant circuit 221 provided by the series circuit composed of coil 222 and nominally heat-invariant dielectric capacitor 255. The functioning of the embodiment illustrated in FIG. 6 is similar to the embodiments illustrated in FIGS. 4 and 5 except that the second resonant circuit 221 serves as a reference circuit to the sensor circuit composed of coil 200 and capacitor 225. In operation, there is generally be two resonances produced, one from the reference circuit and one from the sensor circuit. The determination of these resonances may be done as per the two embodiments illustrated in FIGS. 4 and 5.

Figure 7:
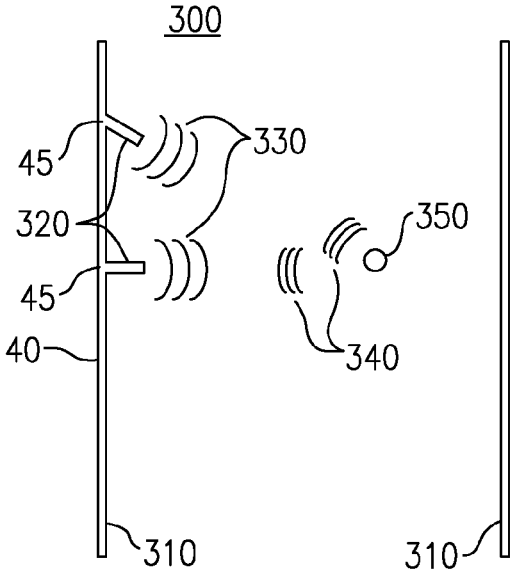
FIG. 7 is a schematic illustration of a radiant syngas cooler (RSC) with active interrogators to gather diagnostic information relating to mass flow or mass flow rate within the RSC.

An embodiment of a non-physically recoverable seed and the associated system elements that are useful for studying the mass flow pattern within the gasification path within the RSC 40 is illustrated in FIG. 7. The RSC's interior walls 310 are host to one or more active interrogators 320 that may be inserted through soot blower ports 45. The active interrogators emit signals 330 that interact with a specially constructed seed 350 resulting in return signals 340. The return signals are received and analyzed by modules not shown. It will be appreciated that the one or more active interrogators 320 may also be located in the gasifier 15. These modules may be collocated with the active emitters (the monostatic case), or not collocated with the active emitters (the bistatic case). The active emitters may be RADAR or LIDAR and they may operate to measure round trip distance from emitter to seed by time-of-flight. Such measurements may be processed to provide information respecting the seed's location. The active emitters may also operate to measure Doppler shifts of the return signals 340. A plurality of such measurements may be processed to provide information respecting the seed's velocity. Also, the active emitters may be operated in a hybrid of the modes of time-of-flight and Doppler. The seed 350 may be constructed so that it is significantly auto-reflective to the specific signals emitted by the active emitters. This can be accomplished by appropriately crafting the seed's RADAR or LIDAR cross-section with respect to the active interrogators' illuminating waveforms. An alternative embodiment uses a plurality of seeds instead of the singlet seed 350.

In another embodiment, a non-physically recoverable seed with the active emitters attached to the injector surface can monitor the flow of seeds that are introduced directly into the gasifier 15, rather than into the RSC 20. In this embodiment, the seeds would need to be of reasonable size to be detected with a surface material constructed of a very high temperature material, such as a ceramic, alumina, zirconia, and the like. Likewise, the resonant electronic circuits are constructed with an appropriate high temperature metal, such as the type used in thermocouples, such as Pt, Pt/Rh, and the like.

It will appreciated that the non-physically recoverable seed on the invention is not limited to having a resonance circuit with a circuit element that changes material property, such as changes in dielectric or a circuit switching (fusible links) system. Rather, the invention can be practiced with a resonant circuit based upon physical deformation, for example, the expansion of a RF resonant cavity as a function of temperature. In another example, the resonance circuit may be a mechanically tuned high temperature material for operating in harsh environments.

Although this invention has been described by way of specific embodiments and examples, it should be understood that various modifications, adaptations, and alternatives may occur to one skilled in the art, without departing from the spirit and scope of the claimed inventive concept. All of the patents, articles, and texts mentioned above are incorporated herein by reference.

What is claimed:

1. A coal gasification system, comprising:

a gasifier;

a radiant syngas cooler (RSC) for receiving gasification products from the gasifier; and a physically recoverable seed introduced into a gas stream of the coal gasification system, the physically recoverable seed comprising a spherical core mass and at least one concentric shell surrounding the spherical core mass, wherein the at least one concentric shell ablates when exposed to a predetermined temperature of an atmosphere within the coal gasification system, thereby providing an estimate of a temperature within the coal gasification system.

2. A method of providing diagnostic information in a coal gasification system, comprising the step of:

introducing a physically recoverable seed comprising a core having a substantially spherical topographic geometry and at least one concentric shell surrounding the core into a gas stream of the coal gasification system, whereby the at least one concentric shell ablates when exposed to a predetermined temperature of an atmosphere within the coal gasification system, thereby providing an estimate of a temperature within the coal gasification system when the seed is physically recovered.

* * * * *